US009932939B2

(12) United States Patent
Williams et al.

(10) Patent No.: US 9,932,939 B2
(45) Date of Patent: Apr. 3, 2018

(54) DEDICATED EXHAUST GAS RECIRCULATION SYSTEM

(71) Applicants: DENSO International America, Inc., Southfield, MI (US); DENSO CORPORATION, Kariya-shi, Aichi-ken (JP)

(72) Inventors: Mark Williams, Gaines, MI (US); Robert Cardno, Novi, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 82 days.

(21) Appl. No.: 15/043,895

(22) Filed: Feb. 15, 2016

(65) Prior Publication Data

US 2017/0234274 A1 Aug. 17, 2017

(51) Int. Cl.

*F02M 25/07* (2006.01)
*F02M 26/70* (2016.01)
*F02M 26/22* (2016.01)

(52) U.S. Cl.

CPC ..... *F02M 26/70* (2016.02); *F02M 26/22* (2016.02)

(58) Field of Classification Search

CPC ..... F02M 26/43; F02M 26/05; F02M 26/41; F02M 26/44; F02M 26/70

See application file for complete search history.

(56) References Cited

U.S. PATENT DOCUMENTS

| | | | | |
|---|---|---|---|---|
| 4,373,498 | A | 2/1983 | Ushimura | |
| 6,164,071 | A * | 12/2000 | Shao | F02B 33/00 123/568.12 |
| 6,216,460 | B1 | 4/2001 | Shao et al. | |
| 6,324,847 | B1 | 12/2001 | Pierpont | |
| 6,945,236 | B2 | 9/2005 | Nakai et al. | |
| 8,291,891 | B2 * | 10/2012 | Alger, II | F02D 13/0238 123/315 |
| 8,944,034 | B2 * | 2/2015 | Gingrich | F02B 27/0215 123/315 |
| 9,435,298 | B2 * | 9/2016 | Hayman | F02M 26/21 |
| 2012/0204844 | A1 * | 8/2012 | Gingrich | F02B 27/0215 123/568.11 |

(Continued)

FOREIGN PATENT DOCUMENTS

| | | | |
|---|---|---|---|
| JP | H08338322 | A | 12/1996 |
| JP | 2005054778 | A | 3/2005 |

*Primary Examiner* — Long T Tran

(74) *Attorney, Agent, or Firm* — Harness, Dickey & Pierce, P.L.C.

(57) ABSTRACT

A dedicated exhaust gas recirculation ("D-EGR") system of an internal combustion engine can include an exhaust recirculation passage, and a rotary valve. The recirculation passage can be coupled for fluid communication with an outlet of a D-EGR combustion chamber. The rotary valve can have a housing and a rotor. The housing can have a valve inlet coupled to the recirculation passage to receive exhaust gases from the recirculation passage, and a valve outlet coupled to an intake passage of the ICE to deliver exhaust gases from the rotary valve to the intake passage. The rotor can be disposed within the housing and rotatable relative to the housing. The rotor and housing can define a plurality of valve chambers.

20 Claims, 2 Drawing Sheets

(56) References Cited

U.S. PATENT DOCUMENTS

| | | | | |
|---|---|---|---|---|
| 2015/0114341 | A1* | 4/2015 | Geckler | F02D 41/0065 123/295 |
| 2015/0337696 | A1* | 11/2015 | Glugla | F02D 21/08 123/574 |
| 2015/0354482 | A1* | 12/2015 | Leone | F02M 26/05 123/568.21 |
| 2015/0361927 | A1* | 12/2015 | Glugla | F02M 25/0749 60/603 |
| 2016/0017847 | A1* | 1/2016 | Hilditch | F02D 41/0052 123/406.48 |
| 2016/0025021 | A1* | 1/2016 | Hilditch | F02M 26/16 60/274 |
| 2016/0040607 | A1* | 2/2016 | Ku | F02D 41/0065 123/568.17 |

* cited by examiner

DEDICATED EXHAUST GAS RECIRCULATION SYSTEM

FIELD

The present disclosure relates to a dedicated exhaust gas recirculation ("D-EGR") system.

BACKGROUND

This section provides background information related to the present disclosure which is not necessarily prior art.

Exhaust gas recirculation (EGR) is a nitrogen oxide (NOx) emissions reduction technique used in internal combustion engines. EGR works by recirculating a portion of an engine's exhaust gas back to the engine cylinders. This dilutes the $O_2$ in the incoming air stream and provides gases inert to combustion to act as absorbents of combustion heat to reduce peak in-cylinder temperatures. NOx is produced in a narrow band of high cylinder temperatures and pressures.

In a gasoline engine, this inert exhaust displaces the amount of combustible matter in the cylinder. In a diesel engine, the exhaust gas replaces some of the excess oxygen in the pre-combustion mixture. Because NOx forms primarily when a mixture of nitrogen and oxygen is subjected to high temperature, the lower combustion chamber temperatures caused by EGR reduces the amount of NOx the combustion generates (though at some loss of engine efficiency). Gases re-introduced from EGR systems will also contain near equilibrium concentrations of NOx and CO; the small fraction initially within the combustion chamber inhibits the total net production of these and other pollutants when sampled on a time average.

While current EGR systems are suitable for their intended use, they are subject to improvement. The present teachings provide for EGR systems that address various shortcomings experienced with current EGR systems, and provide numerous unexpected results. For example, the present teachings advantageously provide for a balanced delivery of recirculated exhaust gas to the engine cylinders across a given engine RPM range.

SUMMARY

This section provides a general summary of the disclosure, and is not a comprehensive disclosure of its full scope or all of its features.

The present teachings are directed to a dedicated exhaust gas recirculation ("D-EGR") system for an internal combustion engine ("ICE"). The D-EGR system includes a rotary valve between the exhaust of a dedicated cylinder of the ICE and the intakes of cylinders of the ICE to control mass flow rate of the D-EGR gases into the cylinders.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are directed to a dedicated exhaust gas recirculation ("D-EGR") system for an internal combustion engine ("ICE"). The D-EGR system includes a rotary valve between the exhaust of a dedicated cylinder and intakes of cylinders of the ICE to control mass flow rate of the EGR gases to the cylinders.

Figure 1:
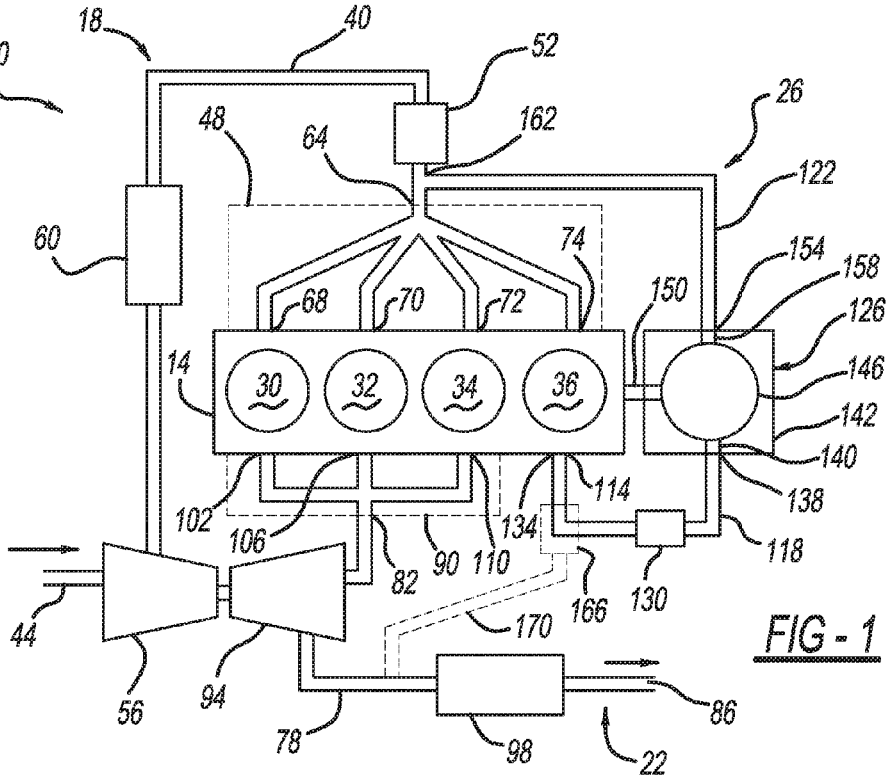
FIG. 1 is a schematic view of an engine and a dedicated exhaust gas recirculation ("D-EGR") system according to the present teachings.

With reference to FIG. 1, an engine system 10 is schematically illustrated. The engine system 10 can include an engine 14, an intake system 18, an exhaust system 22, and a dedicated exhaust gas recirculation ("D-EGR") system 26. The engine 14 can be any suitable type of internal combustion engine ("ICE"), such as a gasoline or diesel engine for example. In the example provided, the engine 14 is a piston-cylinder type engine having four cylinders or combustion chambers (i.e., first chamber 30, second chamber 32, third chamber 34, and fourth chamber 36), though other configurations can be used. The engine system 10 can be used in any suitable application of an ICE, such as a vehicle or a generator for example.

The intake system 18 can include an intake conduit or passage 40 that can receive intake air (e.g., from the atmosphere external to the engine 14) at a first end 44 and supply the intake air to the first through fourth chambers 30, 32, 34, and 36. In the example provided, the intake system 18 also includes an intake manifold 48, a throttle valve 52 (e.g., a butterfly valve), a compressor 56, and an intake gas cooler 60 (e.g., an intercooler). In the example provided, the intake conduit 40 is coupled for fluid communication to the intake manifold 48 at a second end 64 of the intake conduit 40, opposite the first end 44. The intake manifold 48 can be coupled for fluid communication to an intake port or valve (i.e., first intake port 68, second intake port 70, third intake port 72, and fourth intake port 74), of a respective one of the first through fourth chambers 30, 32, 34, and 36 to supply the intake air to that chamber 30, 32, 34, or 36.

The throttle valve 52 can be coupled to the intake conduit 40 between the first end 44 and the second end 64 and configured to control the amount of intake air supplied to the intake manifold 48. The compressor 56 can be coupled to the intake conduit 40 between the first end 44 and the throttle 52 and configured to compress the intake air. The compressor 56 can be any suitable type of compressor, such as a centrifugal compressor, or a screw compressor for example. The intake gas cooler 60 can be coupled to the intake conduit 40 between the compressor 56 and the throttle 52 and configured to cool the compressed intake air. The intake gas cooler 60 can be any suitable type of heat exchanger configured to cool the intake gas.

The exhaust system 22 can include an exhaust conduit or passage 78 that can receive exhaust gases from the first through third chambers 30, 32, and 34 at a third end 82 and release the exhaust gases back to the atmosphere at a fourth end 86. In the example provided, the exhaust system 22 also includes an exhaust manifold 90, a turbine 94, and a catalytic converter 98. In the example provided, the exhaust conduit 78 is coupled for fluid communication to the exhaust manifold 90 at the third end 82. The exhaust manifold 90 can be coupled for fluid communication with an exhaust port or valve (i.e., first exhaust port 102, second exhaust port 106, and third exhaust port 110), of a respective one of the first through third chambers 30, 32, and 34 to receive exhaust gases from that chamber 30, 32, or 34 and supply the exhaust gases to the exhaust conduit 78. In the example provided, the exhaust manifold 90 and the exhaust conduit 78 do not receive exhaust gases from the fourth chamber 36.

In an alternative construction, not specifically shown, the exhaust manifold 90 can receive exhaust gases from the fourth chamber 36 via an exhaust port or valve (i.e., fourth exhaust port 114) of the fourth chamber 36. In such an alternative construction, the exhaust manifold 90 does not permit fluid communication between the fourth exhaust port 114 and the exhaust conduit 78, but does permit fluid communication from the fourth exhaust port 114 to the D-EGR system 26.

The D-EGR system 26 can be configured to receive exhaust gases from the fourth chamber 36 and recirculate those exhaust gases into the intake system 18 to be mixed with the intake air and introduced into the first through fourth chambers 30, 32, 34, and 36 during corresponding intake strokes of the engine 14. The D-EGR system 26 can include a first D-EGR conduit or passage 118, a second D-EGR conduit or passage 122, a rotary valve 126, and a D-EGR cooler 130. In the example provided, the first D-EGR conduit 118 is coupled to the fourth exhaust port 114 at a fifth end 134 of the first D-EGR conduit 118 to receive exhaust gases from the fourth chamber 36. In the example provided, the first D-EGR conduit 118 receives all of the exhaust gases expelled from the fourth chamber 36.

A sixth end 138 of the first D-EGR conduit 118, that is opposite the fifth end 134, can be coupled to an inlet 140 of the rotary valve 126 to provide the exhaust gases from the fourth chamber 36 to the rotary valve 126. The rotary valve 126 can include a housing 142 and a rotor 146. The rotor 146 can be rotatably coupled to the housing 142 and can be disposed within the housing 142, as described in greater detail below. The rotor 146 can be drivingly coupled to an output 150 of the engine 14, such that rotation of the output 150 causes rotation of the rotor 146 relative to the housing 142. The output 150 can be a crankshaft of the engine 14, or a camshaft (e.g., intake valve camshaft) of the engine 14, such that rotation of the output 150 corresponds to the intake strokes of the first through fourth chambers 30, 32, 34, and 36, or the opening and closing of intake valves (e.g., at ports 68, 70, 72, 74) of the first through fourth chambers 30, 32, 34, and 36, as described in greater detail below. The rotor 146 can be drivingly coupled to the output 150 by any suitable means, such as a drive belt, or a drive chain for example.

The second D-EGR conduit 122 can have a seventh end 154 coupled to an outlet 158 of the rotary valve 126 to receive exhaust gases from the rotary valve 126. An eighth end 162 of the second D-EGR conduit 122 can be coupled to the intake system 18 to provide the exhaust gases from the second D-EGR conduit 122 to the first through fourth chambers 30, 32, 34, and 36. In the example provided, the eighth end 162 is coupled to the intake conduit 40 between the throttle 52 and the intake manifold 48, though other configurations can be used.

In the example provided, the D-EGR cooler 130 is coupled to the first D-EGR conduit 118 between the fifth end 134 and the sixth end 138. The D-EGR cooler 130 can be any suitable type of heat exchanger configured to cool the exhaust gases from the fourth chamber 36 before they are introduced to the rotary valve 126. In an alternative construction, not specifically shown, the D-EGR cooler 130 can be located between the rotary valve 126 and the eighth end 162 of the second D-EGR conduit 122.

In an alternative construction, a valve 166 (shown in dashed lines in FIG. 1) can be coupled to the first D-EGR conduit 118 between the fifth and sixth ends 134, 138. In the example shown in dashed lines on FIG. 1, the valve 166 is a three-way valve and is disposed between the D-EGR cooler 130 and the fifth end 134, though other configurations can be used. The valve 166 can be coupled to a third D-EGR conduit 170 (shown in dashed lines in FIG. 1). The third D-EGR conduit 170 can fluidly couple the valve 166 with the exhaust conduit 78. The valve 166 can be selectively operable in a first mode, wherein the valve 166 permits fluid communication between the fourth exhaust port 114 and the rotary valve 126 (via the sixth end 138 of the first D-EGR conduit 118). When operated in the first mode, the valve 166 can prevent fluid communication between the fourth exhaust port 114 and the third D-EGR conduit 170. The valve 166 can be selectively operated in a second mode, wherein the valve 166 prevents fluid communication between the fourth exhaust port 114 and the rotary valve 126. When operated in the second mode, the valve 166 can permit fluid communication between the fourth exhaust port 114 and the third D-EGR conduit 170. In at least one configuration of the engine system 10, the valve 166 can be operated in the second mode during low engine speed (low RPM) operation of the engine 14.

Figure 2:
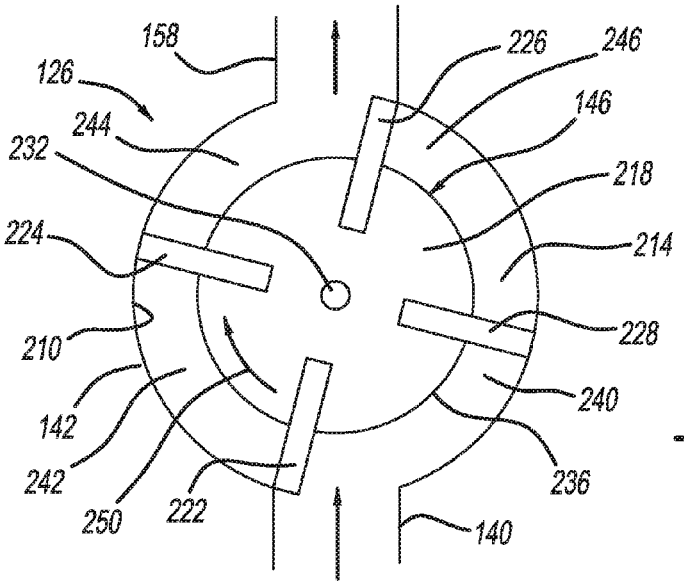
FIG. 2 is a schematic view of a rotary valve of a first construction for use with the D-EGR system of FIG. 1.

With continued reference to FIG. 1 and additional reference to FIG. 2, the housing 142 of the rotary valve 126 can have an inner surface 210 that defines a cavity 214. The cavity 214 can be coupled to the inlet 140 and the outlet 158 to permit exhaust gases to enter and exit the cavity 214 as discussed in greater detail below. The inner surface 210 can be a smooth surface having a cylindrical shape with a generally circular cross-sectional shape.

The rotor 146 can include a rotor body 218 and a plurality of vanes 222, 224, 226, and 228. The rotor body 218 can be centered within the cavity 214 and rotatably coupled to the housing 142. In the example provided, the rotor body 218 is fixedly coupled to a shaft 232 that is rotatably mounted to the housing 142. The shaft 232 can be drivingly coupled to the output 150 of the engine 14 to receive torque therefrom to rotate the rotor body 218. The rotor body 218 can have an outer surface 236 that is spaced apart from and generally opposes the inner surface 210 of the housing 142. In the example provided, the outer surface 236 is a cylindrical surface having a circular cross-sectional shape coaxial with the inner surface 210.

The vanes 222, 224, 226, and 228 can be fixedly coupled to the rotor body 218 and can extend radially outward from the outer surface 236. The vanes 222, 224, 226, and 228 can be configured to contact and seal with the inner surface 210 such that the inner surface 210, the outer surface 236, and adjacent ones of the vanes 222, 224, 226, 228 can define four separate valve chambers (i.e., a first valve chamber 240, a second valve chamber 242, a third valve chamber 244, and a fourth valve chamber 246). The vanes 222, 224, 226, and 228 can be equally spaced apart about the outer surface 236 such that the valve chambers 240, 242, 244, and 246 can generally be quadrants of the cavity 214. The number of vanes 222, 224, 226, 228 can be equal to the number of cylinders of the engine 14, such that the number of valve chambers 240, 242, 244, 246 can equal the number of combustion chambers 30, 32, 34, 36 of the engine 14.

In an alternative construction, not specifically shown, the number of vanes and valve chambers can be greater than the number of combustion chambers.

In the example provided, the total volume of all of the valve chambers 240, 242, 244, 246 combined can equal the volume of the fourth combustion chamber 36. The volume of each of the valve chambers 240, 242, 244, 246 can be the same such that each valve chamber 240, 242, 244, 246 has a volume that is equal to the volume of the fourth combustion chamber 36 divided by the number of combustion chambers 30, 32, 34, 36. In the example provided, the volume of each valve chamber 240, 242, 244, 246 is one quarter of the volume of the fourth combustion chamber 36. In other words, if the engine 14 were a 2 liter engine and each combustion chamber 30, 32, 34, 36 had a displacement of 0.5 liters, the displacement of each valve chamber 240, 242, 244, 246 can be 0.125 liters.

The inlet 140 and outlet 158 can be disposed such that for any rotational position, no single valve chamber 240, 242, 244, 246 is in direct fluid communication with both the inlet 140 and the outlet 158 at the same time. In the example provided, the inlet 140 and the outlet 158 are diametrically opposed about the cavity 214, though other configurations can be used. In the example provided, the rotor 146 rotates in direction 250.

Figure 3:
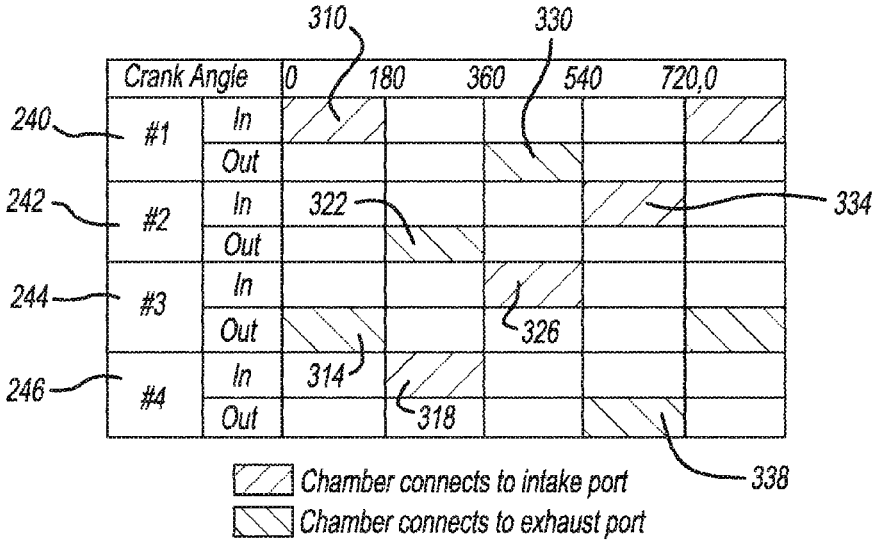
FIG. 3 is a graphical representation of a timing of the rotary valve of FIG. 2 with respect to crank angle of the engine of FIG. 1.

With continued reference to FIGS. 1 and 2, and additional reference to FIG. 3, FIG. 3 illustrates a graph of direct fluid communication between the valve chambers 240, 242, 244, 246 and the inlet 140 or outlet 158 for a particular crankshaft angle (e.g., rotational position of the output 150) of the engine 14. As illustrated in FIG. 3, when the crankshaft angle is between 0° and 180°, the first valve chamber 240 can be in direct fluid communication with the inlet 140 (indicated by box 310) and the third valve chamber 244 can be in direct fluid communication with the outlet 158 (indicated by box 314), while the remaining valve chambers 242 and 246 can be isolated from the inlet 140 and outlet 158.

In operation, when the fourth combustion chamber 36 expels a first amount of exhaust gases (e.g., during an exhaust stroke of the piston associated with the fourth combustion chamber 36), into the first D-EGR conduit 118. This can increase the pressure within the first D-EGR conduit 118. At the same time, the first valve chamber 240 can be in fluid communication with the inlet 140 (e.g., box 310 of FIG. 3) to receive an amount of exhaust gases from the first D-EGR conduit 118 that can be equal to a quarter of the first amount of exhaust gases expelled from the fourth combustion chamber 36. At the same time, the third valve chamber 244 can be in fluid communication with the outlet 158 (e.g., box 314 of FIG. 3) to expel a similar amount of exhaust gases to the second D-EGR conduit 122. This alignment of the third valve chamber 244 with the outlet 158 can be timed to correspond with the opening of intake valves of one of the combustion chambers 30, 32, 34, 36, such that a predetermined amount of exhaust gases can enter that combustion chamber 30, 32, 34, 36.

As the crankshaft continues to rotate, the rotor 146 continues to rotate. When the crankshaft angle is between 180° and 360°, the fourth valve chamber 246 can be in direct fluid communication with the inlet 140 (indicated by box 318) and the second valve chamber 242 can be in direct fluid communication with the outlet 158 (indicated by box 322), while the remaining valve chambers 240, 244 can be isolated from the inlet 140 and outlet 158. At this time, the fourth valve chamber 246 can receive an amount of exhaust gases from the first D-EGR conduit 118 that can be equal to a quarter of the first amount of exhaust gases expelled from the fourth combustion chamber 36. At the same time, the second valve chamber 242 can expel a similar amount of exhaust gases to the second D-EGR conduit 122. This alignment of the second valve chamber 242 with the outlet 158 can be timed to correspond with the opening of intake valves of a different one of the combustion chambers 30, 32, 34, 36, such that a predetermined amount of exhaust gases can enter that combustion chamber 30, 32, 34, 36.

When the crankshaft angle is between 360° and 540°, the third valve chamber 244 can be in direct fluid communication with the inlet 140 (indicated by box 326) and the first valve chamber 240 can be in direct fluid communication with the outlet 158 (indicated by box 330), while the remaining valve chambers 242, 246 can be isolated from the inlet 140 and outlet 158. At this time, the third valve chamber 244 can receive an amount of exhaust gases from the first D-EGR conduit 118 that can be equal to a quarter of the first amount of exhaust gases expelled from the fourth combustion chamber 36. At the same time, the first valve chamber 240 can expel a similar amount of exhaust gases to the second D-EGR conduit 122. This alignment of the first valve chamber 240 with the outlet 158 can be timed to correspond with the opening of intake valves of a different one of the combustion chambers 30, 32, 34, 36, such that a predetermined amount of exhaust gases can enter that combustion chamber 30, 32, 34, 36.

When the crankshaft angle is between 540° and 720°, the second valve chamber 242 can be in direct fluid communication with the inlet 140 (indicated by box 334) and the fourth valve chamber 246 can be in direct fluid communication with the outlet 158 (indicated by box 338), while the remaining valve chambers 240, 244 can be isolated from the inlet 140 and outlet 158. At this time, the second valve chamber 242 can receive an amount of exhaust gases from the first D-EGR conduit 118 that can be equal to a quarter of the first amount of exhaust gases expelled from the fourth combustion chamber 36. At the same time, the fourth valve chamber 246 can expel a similar amount of exhaust gases to the second D-EGR conduit 122. This alignment of the second valve chamber 242 with the outlet 158 can be timed to correspond with the opening of intake valves of a different one of the combustion chambers 30, 32, 34, 36, such that a predetermined amount of exhaust gases can enter that combustion chamber 30, 32, 34, 36.

In the example provided, the crankshaft angle of 720° corresponds to the crankshaft angle of 0°, and the corresponding alignments of the valve chambers 240, 242, 244, 246, with the inlet 140 or outlet 158 repeats the procedure described above. Thus, the rotary valve 126 can block large pulses of exhaust gases (released by the fourth combustion chamber 36) from effecting the amount of exhaust gases introduced to each combustion chamber 30, 32, 34, 36. Thus, the rotary valve 126 can deliver predetermined amounts of exhaust gases to the intake manifold 48 that are phased to correspond to the opening of intake valves of the combustion chambers 30, 32, 34, 36.

Figure 4:
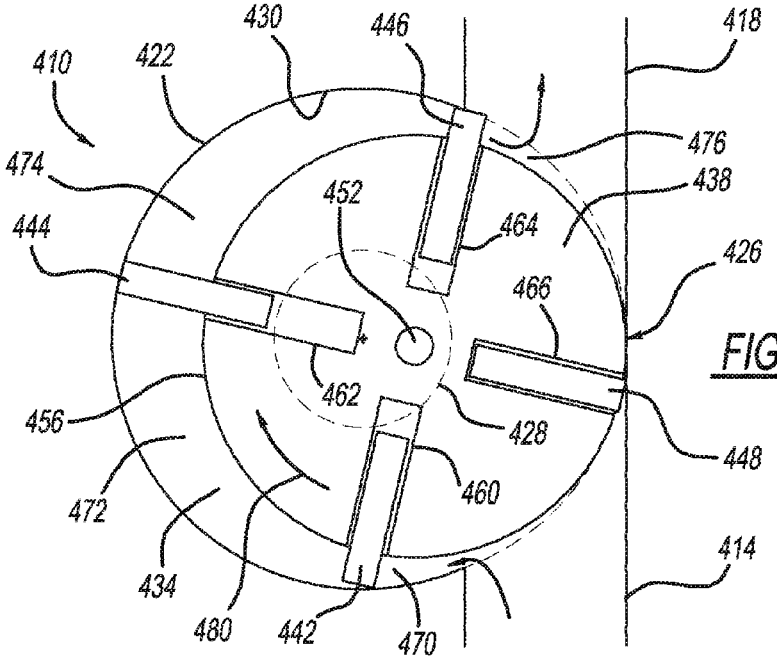
FIG. 4 is a schematic view of a rotary valve of a second construction for use with the D-EGR system of FIG. 1.

With additional reference to FIG. 4, a rotary valve 410 of a second construction is illustrated. The rotary valve 410 can be similar to the rotary valve 126 except as otherwise shown or described herein. The rotary valve 410 can have an inlet 414, an outlet 418, a housing 422, a rotor 426 and a cam 428. The inlet 414 can be coupled to the sixth end 138 (FIG. 1) of the D-EGR conduit 118 (FIG. 1) to receive the exhaust gases from the fourth chamber 36 (FIG. 1). The outlet 418 can be coupled to the seventh end 154 (FIG. 1) of the second D-EGR conduit 122 (FIG. 1) to provide exhaust gases from the rotary valve 410 to the second D-EGR conduit 122 (FIG. 1).

The housing 422 of the rotary valve 410 can have an inner surface 430 that defines a cavity 434. The cavity 434 can be coupled to the inlet 414 and the outlet 418 to permit exhaust gases to enter and exit the cavity 434 as discussed in greater detail below. The inner surface 430 can be a smooth surface having a cylindrical shape with a generally circular cross-sectional shape.

The rotor 426 can include a rotor body 438 and a plurality of vanes 442, 444, 446, 448. The rotor body 438 can be offset from a center of the cavity 434 and rotatably coupled to the housing 422. In the example provided, the rotor body 438 is fixedly coupled to a shaft 452 that is rotatably mounted to the housing 422. The shaft 452 can be drivingly coupled to the output 150 (FIG. 1) of the engine 14 (FIG. 1) to receive torque therefrom to rotate the rotor body 438. The rotor body 438 can have an outer surface 456 that is spaced apart from and generally opposes the inner surface 430 of the housing 422. In the example provided, the outer surface 456 is a cylindrical surface having a circular cross-sectional shape that is not coaxial with the inner surface 430.

The vanes 442, 444, 446, 448 can be coupled to the rotor body 438 such that the vanes 442, 444, 446, 448 can extend radially outward from the outer surface 456. In the example provided, the vanes 442, 444, 446, 448 are received in a respective slot (i.e., first slot 460, second slot 462, third slot 464, or fourth slot 466) defined by the rotor body 438. The vanes 442, 444, 446, 448 can be configured to slide relative to the rotor body 438 such that the vanes 442, 444, 446, 448 can contact and seal with the inner surface 430 as the rotor body rotates.

The cam 428 can act on the vanes 442, 444, 446, 448 to move the vanes 442, 444, 446, 448 radially relative to the rotor body 438 to cause the vanes 442, 444, 446, 448 to contact the inner surface 430. One or more biasing members (not shown) can bias the vanes 442, 444, 446, 448 into contact with the cam 428 such that the vanes 442, 444, 446, 448 can slide along the cam 428.

The inner surface 430, the outer surface 456, and adjacent ones of the vanes 442, 444, 446, 448 can define four separate valve chambers (i.e., a first valve chamber 470, a second valve chamber 472, a third valve chamber 474, and a fourth valve chamber 476). The vanes 442, 444, 446, 448 can be equally spaced apart about the outer surface 456 and the number of the vanes 442, 444, 446, 448 can be equal to the number of cylinders of the engine 14 (FIG. 1), such that the number of valve chambers 470, 472, 474, 476 can equal the number of combustion chambers 30, 32, 34, 36 (FIG. 1) of the engine 14 (FIG. 1).

The operation of the rotary valve 410 can be similar to the operation of rotary valve 126 except as shown or described herein. In operation, as the rotor body 438 rotates in direction 480, exhaust gases are drawn into the first valve chamber 470 by the expanding volume of the first valve chamber 470. In the rotational position shown, the exhaust gases in the fourth valve chamber 476 are expelled from the rotary valve 410 through the outlet 418 by the compressing volume of the fourth valve chamber 476.

In the example provided, the maximum volume of each of the valve chambers 470, 472, 474, 476 throughout a full revolution of the rotor body 438 can be equal to the volume of the fourth combustion chamber 36 (FIG. 1) divided by the number of combustion chambers 30, 32, 34, 36, (e.g., one quarter of the volume of the fourth combustion chamber 36 (FIG. 1).

Similar to the rotary valve 126, when the fourth combustion chamber 36 (FIG. 1) expels a first amount of exhaust gases (e.g., during an exhaust stroke of the piston associated with the fourth combustion chamber 36), into the first D-EGR conduit 118 (FIG. 1). This can increase the pressure within the first D-EGR conduit 118 (FIG. 1). At the same time, the first valve chamber 470 can be in fluid communication with the inlet 414 to receive an amount of exhaust gases from the first D-EGR conduit 118 (FIG. 1) that can be equal to a quarter of the first amount of exhaust gases expelled from the fourth combustion chamber 36 (FIG. 1). At the same time, the fourth valve chamber 476 can be in fluid communication with the outlet 418 to expel a similar amount of exhaust gases to the second D-EGR conduit 122 (FIG. 1). This alignment of the fourth valve chamber 476 with the outlet 418 can be timed to correspond with the opening of intake valves of one of the combustion chambers 30, 32, 34, 36 (FIG. 1), such that a predetermined amount of exhaust gases can enter that combustion chamber 30, 32, 34, 36 (FIG. 1).

As the crankshaft continues to rotate, the rotor 426 continues to rotate such that the respective volumes of exhaust gases within the first, second, and third valve chambers 470, 472, 474 are each expelled through the outlet 418 at times that correspond with the opening of intake valves of other ones of the combustion chambers 30, 32, 34, 36 (FIG. 1), such that a predetermined amount of exhaust gases can enter that combustion chamber 30, 32, 34, 36 (FIG. 1). Thus, the rotary valve 410 can deliver predetermined amounts of exhaust gases to the intake manifold 48 (FIG. 1) that are phased to correspond to the opening of intake valves of the combustion chambers 30, 32, 34, 36 (FIG. 1).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A dedicated exhaust gas recirculation system comprising:

an internal combustion engine having a plurality of combustion chambers, one of the combustion chambers being a dedicated exhaust gas recirculation combustion chamber; and a rotary valve having a valve inlet coupled to an outlet of the dedicated exhaust gas recirculation combustion chamber to receive exhaust gases only from the dedicated exhaust gas recirculation combustion chamber, and a valve outlet coupled to an intake manifold of the combustion chambers to deliver exhaust gases from the rotary valve to the intake manifold, the rotary valve defining a plurality of valve chambers, each valve chamber being configured to deliver a discrete amount of exhaust gas to the intake manifold.

2. The dedicated exhaust gas recirculation system of claim 1, wherein the number of valve chambers is equal to or greater than a total number of combustion chambers.

3. The dedicated exhaust gas recirculation system of claim 1, wherein the rotary valve includes a housing and a rotor that is rotatably disposed within the housing, the rotor being drivingly coupled to an output of the internal combustion engine.

4. The dedicated exhaust gas recirculation system of claim 3, wherein the output of the internal combustion engine is a crankshaft of the internal combustion engine.

5. The dedicated exhaust gas recirculation system of claim 3, wherein the output of the internal combustion engine is a camshaft of the internal combustion engine.

6. The dedicated exhaust gas recirculation system of claim 1, further comprising a heat exchanger located between the outlet of the dedicated exhaust gas recirculation combustion chamber and the rotary valve, the heat exchanger configured to cool exhaust gases before the exhaust gases enter the rotary valve.

7. The dedicated gas recirculation system of claim 1, wherein the rotary valve includes a housing and a rotor that is rotatably disposed within the housing, the rotor including a rotor body and a plurality of vanes that extend radially outward from the rotor body to contact an inner surface of the housing, wherein the rotor body, the housing, and adjacent ones of the vanes define the valve chambers.

8. The dedicated exhaust gas recirculation system of claim 7, wherein the rotor body and vanes are configured to permit a total volume of each valve chamber to change as the rotor rotates relative to the housing.

9. The dedicated exhaust gas recirculation system of claim 8, wherein the vanes are slidably coupled to the rotor body to permit the vanes to slide radially outward and radially inward relative to the rotor body.

10. The dedicated exhaust gas recirculation system of claim 1, wherein the rotary valve is configured such that each of the valve chambers is in fluid communication with the valve outlet when a corresponding one of the combustion chambers is configured to receive intake gases from the intake manifold.

11. The dedicated exhaust gas recirculation system of claim 1, wherein the rotor and housing define a number of valve chambers equal to or greater than a total number of primary combustion chambers and D-EGR combustion chambers.

12. The dedicated exhaust gas recirculation system of claim 1, further comprising a heat exchanger located between the exhaust recirculation passage and the rotary valve, the heat exchanger configured to cool exhaust gases before the exhaust gases enter the rotary valve.

13. The dedicated gas recirculation system of claim 1, wherein the rotor includes a rotor body and a plurality of vanes that extend radially outward from the rotor body to contact an inner surface of the housing, wherein the rotor body, the housing, and adjacent ones of the vanes define the valve chambers.

14. The dedicated exhaust gas recirculation system of claim 13, wherein the rotor body and vanes are configured to permit a total volume of each valve chamber to change as the rotor rotates relative to the housing.

15. The dedicated exhaust gas recirculation system of claim 14, wherein the vanes are slidably coupled to the rotor body to permit the vanes to slide radially outward and radially inward relative to the rotor body.

16. The dedicated exhaust gas recirculation system of claim 1, wherein the rotor is rotates such that each of the valve chambers is in fluid communication with the valve outlet when a corresponding one of the primary or D-EGR combustion chambers receives intake gases from the intake passage.

17. The dedicated exhaust gas recirculation system of claim 1, wherein the vanes of the rotor are slidably coupled to the rotor body to permit the vanes to slide radially outward and radially inward relative to the rotor body to vary the volume of each of the valve chambers as the rotor rotates relative to the housing.

18. A dedicated exhaust gas recirculation system comprising:

an internal combustion engine having a plurality of primary combustion chambers, a D-EGR combustion chamber, an intake passage, and an exhaust passage, the intake passage being coupled for fluid communication with an inlet of each of the primary combustion chambers and an inlet of the D-EGR combustion chamber, the exhaust passage being coupled for fluid communication with an outlet of each of the primary combustion chambers to receive exhaust gases from the primary combustion chambers, the exhaust passage not being coupled for fluid communication with the D-EGR combustion chamber;

an exhaust recirculation passage coupled for fluid communication with an outlet of the D-EGR combustion chamber to receive exhaust gases from the D-EGR combustion chamber; and a rotary valve having a housing and a rotor, the housing having a valve inlet coupled to the exhaust recirculation passage to receive exhaust gases from the exhaust recirculation passage, and a valve outlet coupled to the intake passage to deliver exhaust gases from the rotary valve to the intake passage, the rotor being disposed within the housing and rotatable relative to the housing, the rotor and housing defining a plurality of valve chambers, the rotor being drivingly coupled to one of a camshaft or a crankshaft of the internal combustion engine.

19. A dedicated exhaust gas recirculation system comprising:

an internal combustion engine having a plurality of primary combustion chambers, a D-EGR combustion chamber, an intake passage, and an exhaust passage, the intake passage being coupled for fluid communication with an inlet of each of the primary combustion chambers and an inlet of the D-EGR combustion chamber, the exhaust passage being coupled for fluid communication with an outlet of each of the primary combustion chambers to receive exhaust gases from the primary combustion chambers, the exhaust passage not being coupled for fluid communication with the D-EGR combustion chamber;

an exhaust recirculation passage coupled for fluid communication with an outlet of the D-EGR combustion chamber to receive exhaust gases from the D-EGR combustion chamber; and a rotary valve having a housing and a rotor, the housing having a valve inlet coupled to the exhaust recirculation passage to receive exhaust gases from the exhaust recirculation passage, and a valve outlet coupled to the intake passage to deliver exhaust gases from the rotary valve to the intake passage, the rotor being disposed within the housing and rotatable relative to the housing, the rotor including a rotor body and a plurality of vanes that extend radially outward from the rotor body to cooperate with the rotor body and the housing to define a number of valve chambers equal to a total number of primary and D-EGR combustion chambers, the rotor rotating relative to the housing such that each of the valve chambers is in fluid communication with the valve outlet when a corresponding one of the primary or D-EGR combustion chambers receives intake gases from the intake passage.

20. The dedicated exhaust gas recirculation system of claim 19, wherein the rotor body is drivingly coupled to an output of the internal combustion engine that includes one of a crankshaft or a camshaft of the internal combustion engine.

* * * * *